US008146496B2

(12) United States Patent
Glunz et al.

(10) Patent No.: US 8,146,496 B2
(45) Date of Patent: Apr. 3, 2012

(54) PRINTING PLATE HANDLING DEVICE

(75) Inventors: Wolfgang Glunz, Augsburg (DE); Albert Heller, Pestenacker (DE); Georg Kassmair, Zusamzell (DE); Rainer Kiesswetter, Neusaess (DE); Michael Scholz, Muensterhausen (DE)

(73) Assignee: manroland AG, Offenbach am Main (DE)

( * ) Notice: Subject to any disclaimer, the term of this patent is extended or adjusted under 35 U.S.C. 154(b) by 464 days.

(21) Appl. No.: 12/427,141

(22) Filed: Apr. 21, 2009

(65) Prior Publication Data

US 2009/0266257 A1 Oct. 29, 2009

(30) Foreign Application Priority Data

Apr. 29, 2008 (DE) ..... 10 2008 021 316

(51) Int. Cl.
*B41F 27/12* (2006.01)

(52) U.S. Cl. ..... 101/477; 101/479; 101/415.1

(58) Field of Classification Search ..... 101/477, 101/479, 480; 294/187; *B41F 27/12*
See application file for complete search history.

(56) References Cited

U.S. PATENT DOCUMENTS 4,727,807 A 3/1988 Suzuki et al.

FOREIGN PATENT DOCUMENTS

| | | | |
|---|---|---|---|
| DE | 42 19 822 | | 12/1993 |
| DE | 298 22 104 | | 4/1999 |
| DE | 199 34 271 | | 5/2000 |
| DE | 102 61 981 | | 3/2004 |
| DE | 103 38 372 | | 3/2005 |
| DE | 103 38 373 | | 3/2005 |
| DE | 103 38 374 | | 3/2005 |
| DE | 102004061135 | A1 * | 9/2005 |
| DE | 10 2004 052 021 | | 5/2006 |
| JP | 08067001 | A * | 3/1996 |

* cited by examiner

*Primary Examiner* — Leslie J Evanisko
(74) *Attorney, Agent, or Firm* — Cozen O'Connor

(57) ABSTRACT

A printing plate handling device for holding a printing plate (11) adjacent to one edge (12) of the plate, especially adjacent to a bent-over leading edge or a bent-over trailing edge of the printing plate, with a mechanism for holding the printing plate (11) in a flat, frictionally-engaged manner along a surface area of the printing plate adjacent to one edge (12) of the printing plate.

10 Claims, 4 Drawing Sheets

PRINTING PLATE HANDLING DEVICE

BACKGROUND OF THE INVENTION

1. Field of the Invention

The present invention pertains to a printing plate handling device

2. Description of the Related Art

Especially in the case of web-fed rotary printing presses designed as commercial web presses, printing plates which extend over the entire axial length of the form cylinder are clamped onto the form cylinders of the printing couples of the printing press. As the axial length of the form cylinder increases, the axial dimension of the printing plate also increases. As a result with every increase in the axial dimension of the printing plate, the handling of the plate becomes more difficult. When printing plates of considerable axial length are to be handled, therefore, there is the danger that they can buckle under their own weight and thus be damaged. This must be reliably avoided.

SUMMARY OF THE INVENTION

Against this background, it is an object of the present invention to create a novel printing plate handling device by means of which printing plates can be handled without the danger of buckling.

This object is achieved by providing a printing plate handling device for gripping a printing plate adjacent to one of its edges, especially adjacent to a bent-over leading edge or a bent-over trailing edge of the printing plate, and comprises a mechanism for holding the printing plate to be gripped in a flat, frictionally-engaged manner along a surface area of the printing plate extending adjacent to one edge of the printing plate.

The printing plate handling device of the present invention comprises a mechanism for the flat, frictionally-engaged holding of a printing plate to be gripped along a surface area of the plate adjacent to one edge of the plate. Because the printing plate to be gripped is held in place in a flat, frictionally-engaged manner, the plate is stiffened and stabilized while it is being handled by the printing plate handling device, so that, even in the case of large-format printing plates with short bent-over side pieces, it is possible reliably to prevent the printing plates from buckling. By the use of the handling device of the present invention, therefore, large-format printing plates can be prevented from being damaged when being transported or subjected to other handling operations.

According to an advantageous embodiment of the present invention, the printing plate handling device comprises a mechanism which allows gripping of a printing plate with the correct register.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

Exemplary embodiments of the present invention are explained in greater detail below on the basis of the drawing, although the invention is not limited to them.

DETAILED DESCRIPTION OF THE PRESENTLY PREFERRED EMBODIMENTS

The present invention relates to a printing plate handling device for handling especially large-format printing plates such as those used in commercial web presses.

Figure 1:
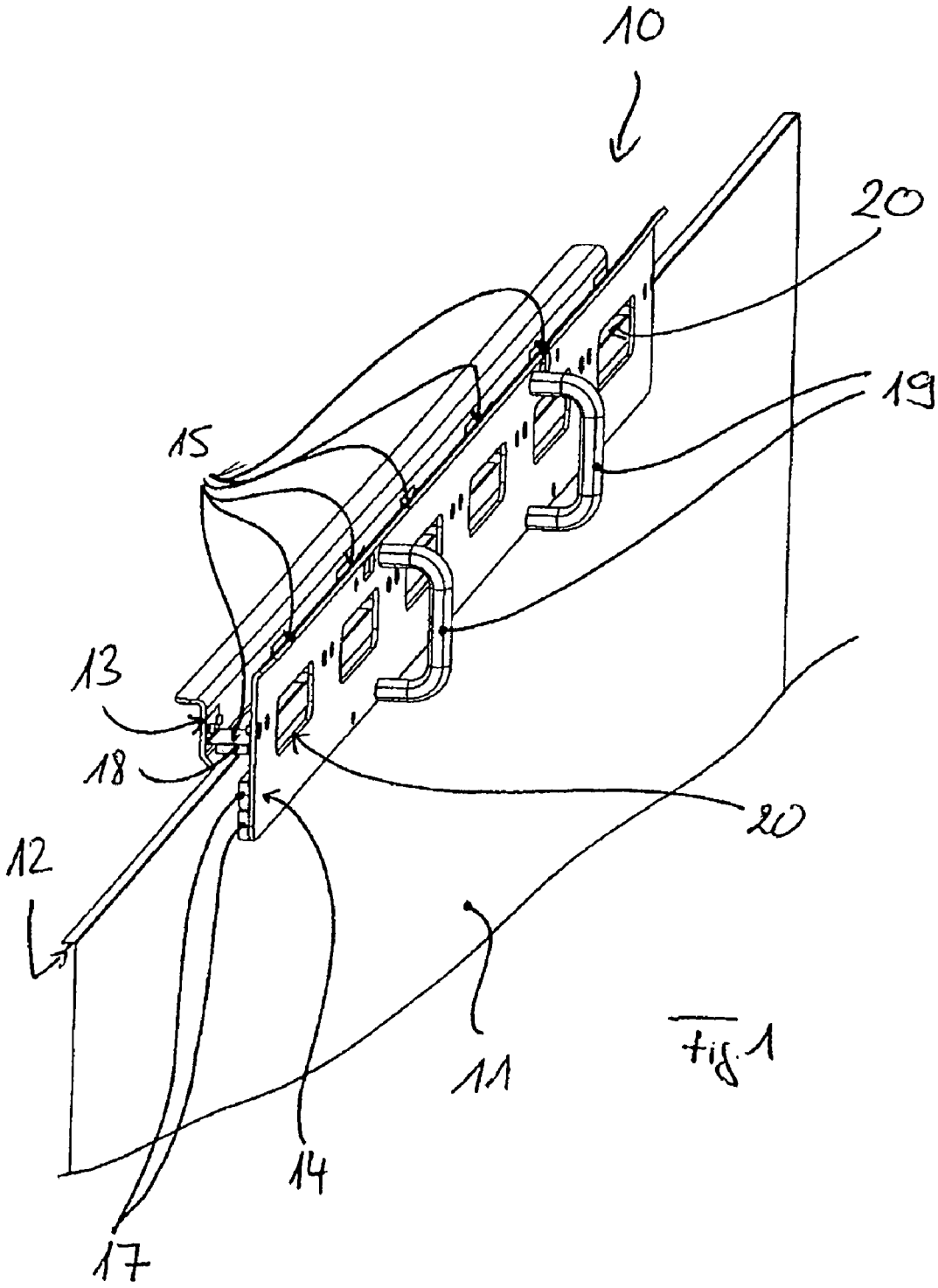
FIG. 1 is a perspective view of the printing plate handling device of the present invention.
Figure 2:
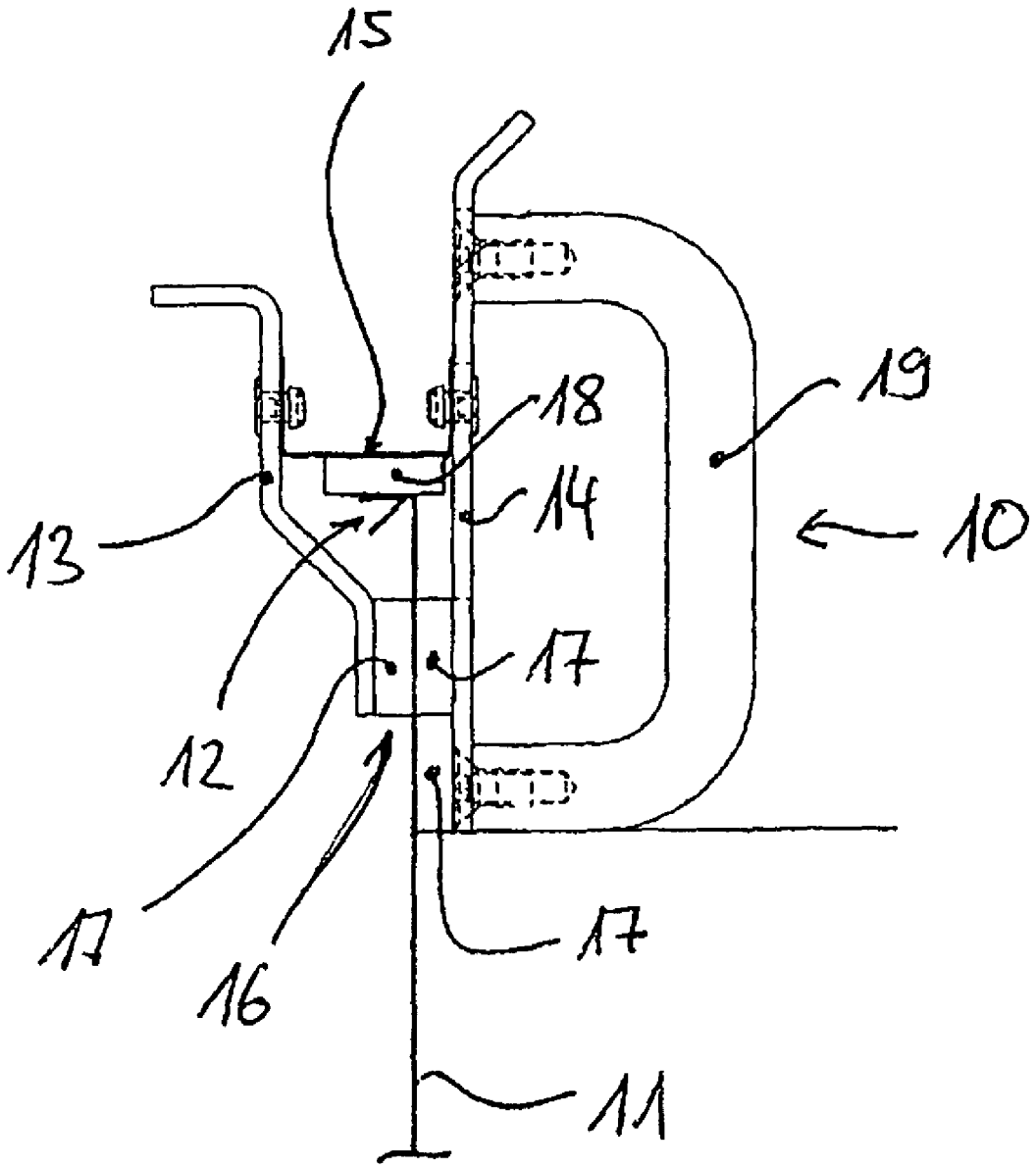
FIG. 2 is a side view of the printing plate handling device of FIG. 1.

FIGS. 1 and 2 show a printing plate handling device 10 of the present invention together with a printing plate 11, which has been picked up by the printing plate handling device 10. The printing plate handling device 10 is used to grip the printing plate 11 in an area extending along a bent-over edge 12 of the printing plate 11, where the edge 12 can be a leading edge or a trailing edge of the printing plate 11. The printing plate handling device 10 comprises a mechanism for holding the printing plate 11 in a flat, frictionally-engaged manner along a surface area adjacent the edge 12. Because it is held in a flat, frictionally-engaged manner, the printing plate 11 is stiffened and therefore stabilized in the area of the printing plate handling device 10, so that there is no danger that, when the printing plate 11 is being handled by means of the printing plate handling device 10, the printing plate 11 could buckle under its own weight.

In the exemplary embodiment shown in FIGS. 1 and 2, the mechanism for holding the printing plate 11 to be gripped in a flat, frictionally-engaged manner is formed by two clamping side pieces 13, 14. The side pieces 13, 14 are connected to each other by spring elements 15 in such a way that the clamping side pieces 13, 14 can be shifted with respect to each other, that is, pivoted toward each other, against the force of the spring elements 15. After the clamping side pieces 13, 14 have been pivoted toward each other against the force of the spring elements 15, a clamping area 16, defined by the clamping side pieces 13, 14, is opened to allow the insertion of the printing plate 11 to be handled by the printing plate handling device 10.

As a result of the elastic force of the spring elements 15, the clamping area 16 can then be closed to grip by frictional engagement the printing plate 11 which has been inserted into the clamping area 16.

According to FIG. 1, elastic contact elements 17 are assigned to the clamping side pieces 13, 14 in the clamping area 16. After the clamping area 16 has been closed and thus the clamping side pieces 13, 14 have been moved toward each other by the each of the spring elements 15, the printing plate 11 is gripped by frictional engagement between these contact elements. As shown in FIG. 2, an elastic contact element 18 is also assigned to the spring elements 15. The printing plate 11 inserted into the clamping area 16 rests by the edge 12 inserted into the clamping area 16 against these additional contact element 18.

According to FIGS. 1 and 2, handles 19 are assigned to the printing plate handling device 10. The printer will use the handles 19 to grip the inventive printing plate handling device 10, especially after a printing plate 11 has been frictionally engaged by the printing plate handling device 10. In the exemplary embodiment of FIGS. 1 and 2, the handles 19 are assigned to one of the clamping side pieces 14.

In the printing plate handling device 10, openings 20 are also introduced as shown in FIG. 1. The openings 20 can be used to hang the printing plate handling device 10, together with the printing plate 11 frictionally engaged by the device, on a printing plate transport unit (not shown) such as a printing plate transport cart or a printing plate lift, without the printing plate 11 being held frictionally in the printing plate handling device 10 coming in contact with the printing plate transport unit and thus without being damaged by it. In the exemplary embodiment shown here, the openings 20 are introduced into the clamping side piece 14. It is also possible to introduce corresponding openings in the clamping side piece 13.

In addition to the frictional engagement of the printing plate 11 in the printing plate handling device 10, a positive means of securing the printing plate 11 in the printing plate handling device 10 is also provided. That is, the edge 12 of the printing plate 11 projecting into the clamping area 16 serves this function. As a result, the printing plate 11 is prevented from falling out of the printing plate handling device 10.

The inventive printing plate handling device is characterized by a compact design and light weight. As a result, printing plates can be easily handled, and several printing plates, each of which is in the grip of a printing plate handling device, can be compactly arranged on a printing plate transport unit.

The inventive printing plate handling device 10 is used preferably to pick up a printing plate immediately after the leading and trailing edges of the printing plate have been bent over in the area of a bending machine. The printing plate preferably remains in the grip of the printing plate handling device 10 over its entire transport route, that is, until it is transferred to a printing press or until the printing plate is clamped onto a form cylinder of the printing press.

Figure 3:
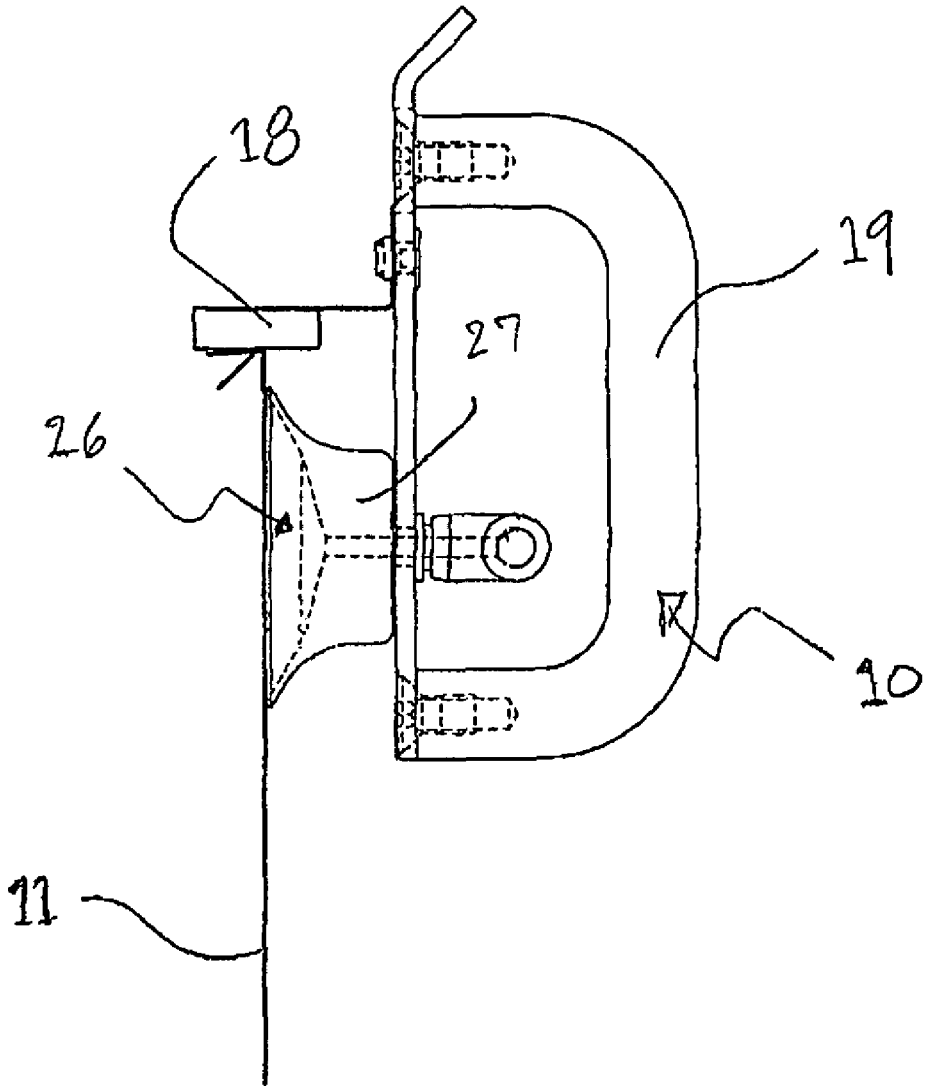
FIG. 3 is a side view of another embodiment of the printing plate handling device of the present invention.

In the exemplary embodiment shown in FIGS. 1 and 2, the printing plate 11 is held by frictional engagement in the printing plate handling device 10 by means of the clamping side pieces 13, 14, which are pressed together by spring elements 15. In contrast to that, it is also possible to produce the frictional engagement by which the printing plate 11 is gripped in the printing plate handling device 10 by providing a suction device 26 designed as a vacuum unit 27 as shown in FIG. 3.

The inventive printing plate handling device 10 can be used to transfer the gripped printing plate with the correct lateral register to a form cylinder of a printing couple of a printing press.

Figure 4:
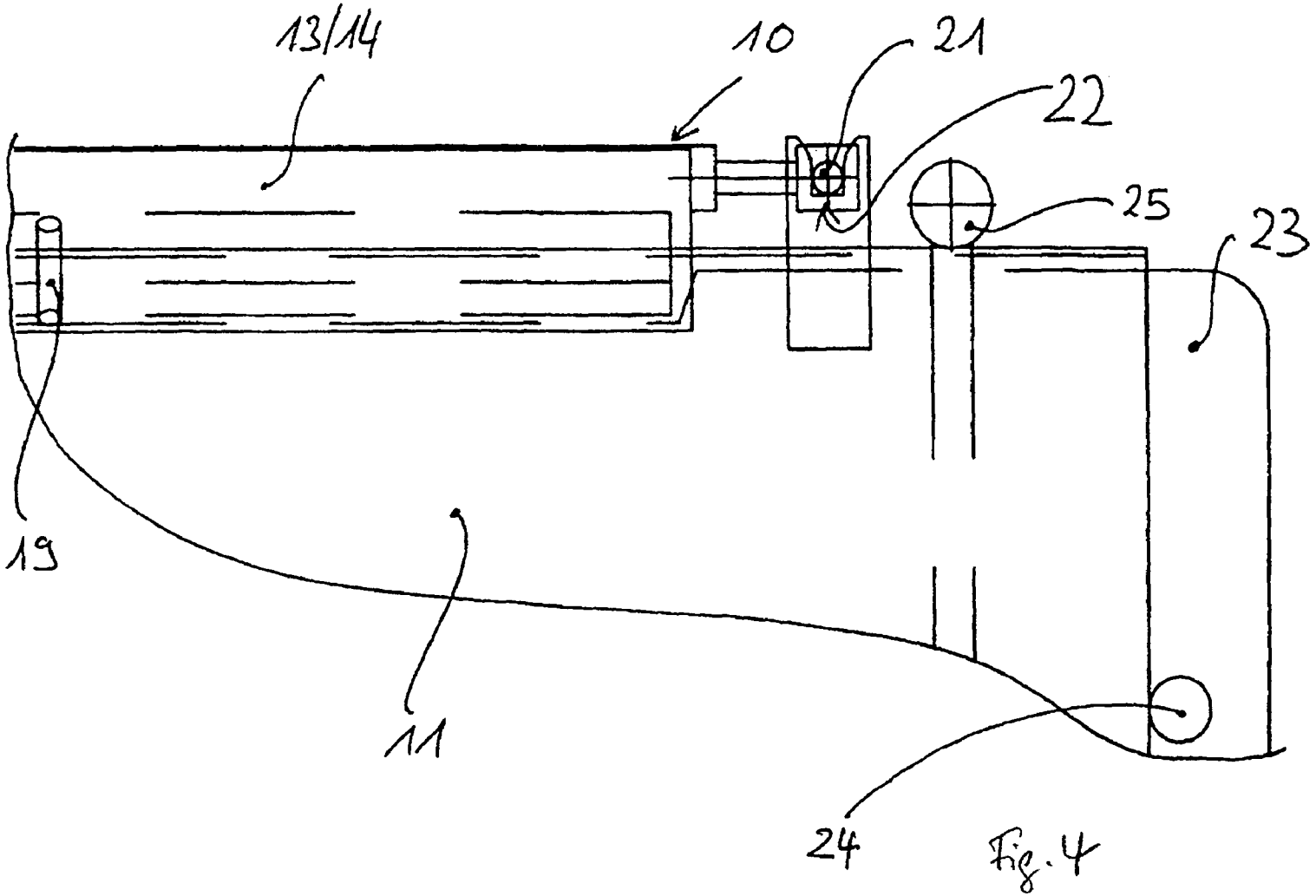
FIG. 4 is a partial side view of another inventive printing plate handling device together with a printing plate preparation table.

FIG. 4 shows an advantageous embodiment of the printing plate handling device 10 of FIGS. 1 and 2. The printing plate handling device 10 of FIG. 4 comprises a mechanism for gripping the printing plate 11 with the correct register. The mechanism for gripping the printing plate 11 with the correct register comprises guide pins 21 formed on both ends of the clamping side pieces 13, 14. The guide pins 21, as shown in FIG. 4, can be introduced into guide grooves 22 of a printing plate preparation table 23, especially a table 23 of a printing plate bending device, in such a way that the printing plate 11 being held ready on a printing plate preparation table 23 is picked up by the clamping side pieces 13, 14 with the correct register.

Thus, according to FIG. 4, the printing plate 11 to be picked up by the printing plate handling device 10 is oriented by stops 24, 25 on the printing plate preparation table 23. The printing plate 12, which is oriented on the printing plate preparation table 23 with the correct register, is then picked up with the correct register by the printing plate handling device 10, namely, by the cooperation between the guide pins 21 of the printing plate handling device 10 and the guide grooves 22 of the printing plate preparation table 23.

A printing plate 11 which has been picked up with the correct register by the printing plate handling device 10 remains correctly oriented with respect to its register in the printing plate handling device 10 over the course of its entire transport route, i.e., until the printing plate 11 is transferred to a printing couple of a printing press, where, upon transfer of the printing plate 11 to the printing couple of a printing press, the guide pins 21 of the printing plate handling device 10 can be introduced into guide grooves of the printing couple (not shown) in such a way that a printing plate which is being held in correct register between the clamping side pieces 13, 14 of the printing plate handling device 10 is transferred with the correct register, namely, with both correct lateral register and correct diagonal register, to the printing couple.

The invention is not limited by the embodiments described above which are presented as examples only but can be modified in various ways within the scope of protection defined by the appended patent claims.

We claim:

1. A printing plate handling device for gripping a printing plate adjacent to an edge of the printing plate at one of a bent-over leading edge and a bent-over trailing edge of the printing plate, said printing plate handling device comprising:

a mechanism including two opposed clamping side pieces for holding the printing plate in a flat, frictionally-engaged manner along a surface area of the printing plate adjacent to the edge of the printing plate; and a mechanism for holding the printing plate with a defined register, the mechanism for holding the printing plate with the defined register comprising:

guide pins at both ends of the opposed clamping side pieces, the guide pins being introduceable into guide grooves of a printing plate preparation table so that the printing plate being held ready on the printing plate preparation table is gripped between the opposed clamping side pieces with the defined register, and said guide pins being introduceable into guide grooves of a printing couple so that a printing plate held with the defined register between the opposed clamping side pieces is transferred with the defined register to the printing couple.

2. The printing plate handling device according to claim 1, wherein said mechanism for the flat, frictionally-engaged holding of the printing plate further comprises spring elements for connecting said opposed clamping side pieces to each other so that said opposed clamping side pieces are pivotable toward each other against a force of the spring elements so that a clamping area defined by said opposed clamping side pieces is opened to permit introduction of the printing plate; and so that said opposed clamping side pieces are pivotable toward each other by the force of the spring elements such that a clamping area for the frictionally-engaged holding of the printing plate which has been introduced into the clamping area is closed.

3. The printing plate handling device according to claim 2, further comprising elastic contact elements associated with the opposed clamping side pieces within the clamping area for frictionally engaging the printing plate therebetween when the clamping area is closed.

4. The printing plate handling device according to claim 2, further comprising handles attached to a clamping side piece of the opposed clamping side pieces.

5. The printing plate handling device according of claim 1, further comprising a handle.

6. The printing plate handling device according to claim 1, wherein said mechanism has openings for hanging said printing plate handling device on a printing plate transport unit so that the printing plate being held frictionally by said printing plate handling device does not come in contact with the printing plate transport unit.

7. The printing plate handling device according to claim 6, wherein said openings are located in a clamping side piece of the opposed clamping side pieces.

8. The printing plate handling device according to claim 1, wherein the printing plate includes one of a bent-over leading and a bent-over trailing edge, and wherein said printing plate handling device additionally comprises a mechanism for holding said frictionally-engaged printing plate in place by a positive-type connection.

9. The printing plate handling device according to claim 8, wherein said positive-type connection is achieved one of by projecting the bent-over leading edge projecting into a clamping area or by projecting the bent-over trailing edge projecting into the clamping area.

10. The printing plate handling device according to claim 1, wherein said mechanism for the flat, frictionally-engaged holding of the printing plate includes a suction unit.

* * * * *